United States Patent [19]

Hansen

[11] Patent Number: 4,483,175

[45] Date of Patent: Nov. 20, 1984

[54] THIN WALL TUBE STRAIGHTENING APPARATUS

[76] Inventor: Edward L. Hansen, 79311 Ave. 40, Indio, Calif. 92201

[21] Appl. No.: 450,698

[22] Filed: Dec. 17, 1982

[51] Int. Cl.[3] ..... B21D 31/00

[52] U.S. Cl. ..... 72/389; 72/458

[58] Field of Search ..... 72/389, 390, 384, 386, 72/388, 458, 705

[56] References Cited

U.S. PATENT DOCUMENTS

| | | | |
|---|---|---|---|
| 108,123 | 10/1870 | Emerson | 72/386 |
| 853,513 | 5/1907 | Keith et al. | 72/386 |
| 1,054,132 | 2/1913 | Miner | 72/389 |
| 1,651,546 | 12/1927 | Reynolds | 72/389 |
| 1,907,925 | 5/1933 | Wochner | 72/389 |
| 2,531,728 | 11/1950 | Gersh | 153/38 |
| 2,755,761 | 7/1956 | Carr | 113/111 |
| 3,415,104 | 12/1968 | Conklin | 72/400 |
| 3,531,972 | 10/1970 | Smith | 72/389 |
| 4,184,356 | 1/1980 | Wittmer | 72/458 |
| 4,282,737 | 8/1981 | Maples | 72/388 |

FOREIGN PATENT DOCUMENTS

| | | | |
|---|---|---|---|
| 2223461 | 11/1973 | Fed. Rep. of Germany | 72/389 |

*Primary Examiner*—Daniel C. Crane
*Assistant Examiner*—David B. Jones
*Attorney, Agent, or Firm*—Henderson & Sturm

[57] ABSTRACT

This invention relates to tube straightening apparatus in general and more specifically to a lightweight tube straightening device that has a unique rolling fulcrum, that allows the straightening forces to be applied along a wide area of the running tube length.

7 Claims, 3 Drawing Figures

THIN WALL TUBE STRAIGHTENING APPARATUS

BACKGROUND OF THE INVENTION

The prior art is replete with tube straightening apparatus as can be seen by reference to U.S. Pat. Nos. 2,531,728; 4,282,737; 2,415,104 and 2,755,761.

While these previously patented items are adequate for their intended purpose, they are deficient for one or more of the following reasons; undue mechanical complexity; restricted area of application of force; complexity of set up and adjustment; and failure to apply force along the running length of the tube.

Up until the present time no one has developed a simple, efficient, lightweight, tube straightening apparatus that can be quickly deployed to straighten out thin walled tubular structures, such as are found in corral fences. Furthermore, no one previously has thought of a rolling fulcrum for this type of a device, so that the straightening forces can be applied along the running length of the tubular member.

SUMMARY OF THE INVENTION

An object of the present invention is the provision of a simple, efficient, lightweight tube straightening apparatus.

Another object of the present invention is the provision of a tube straightening apparatus that has only two major components.

Still another object of the present invention is the provision of a tube straightening apparatus that can be quickly clamped to a bent corral fence, and used to straighten out the fence section while the horses remain within the enclosure.

Yet another object of the present invention is to introduce a revolutionary, new, rolling fulcrum concept into the art of tube straightening devices.

A further object of the present invention is to provide a tube straightening apparatus that can be operated with either the right or left hand, and has a dead center lock so that the correction can be inspected as the tube is being straightened.

A yet further object of the present invention is the provision of tube straightening apparatus, that applies the straightening forces along the running length of the bent tube.

These and other objects advantages and novel features of the invention will become apparent from the detailed description that follows when viewed in conjunction with the accompanying drawings.

DETAILED DESCRIPTION OF THE PREFERRED EMBODIMENT

Figure 1:
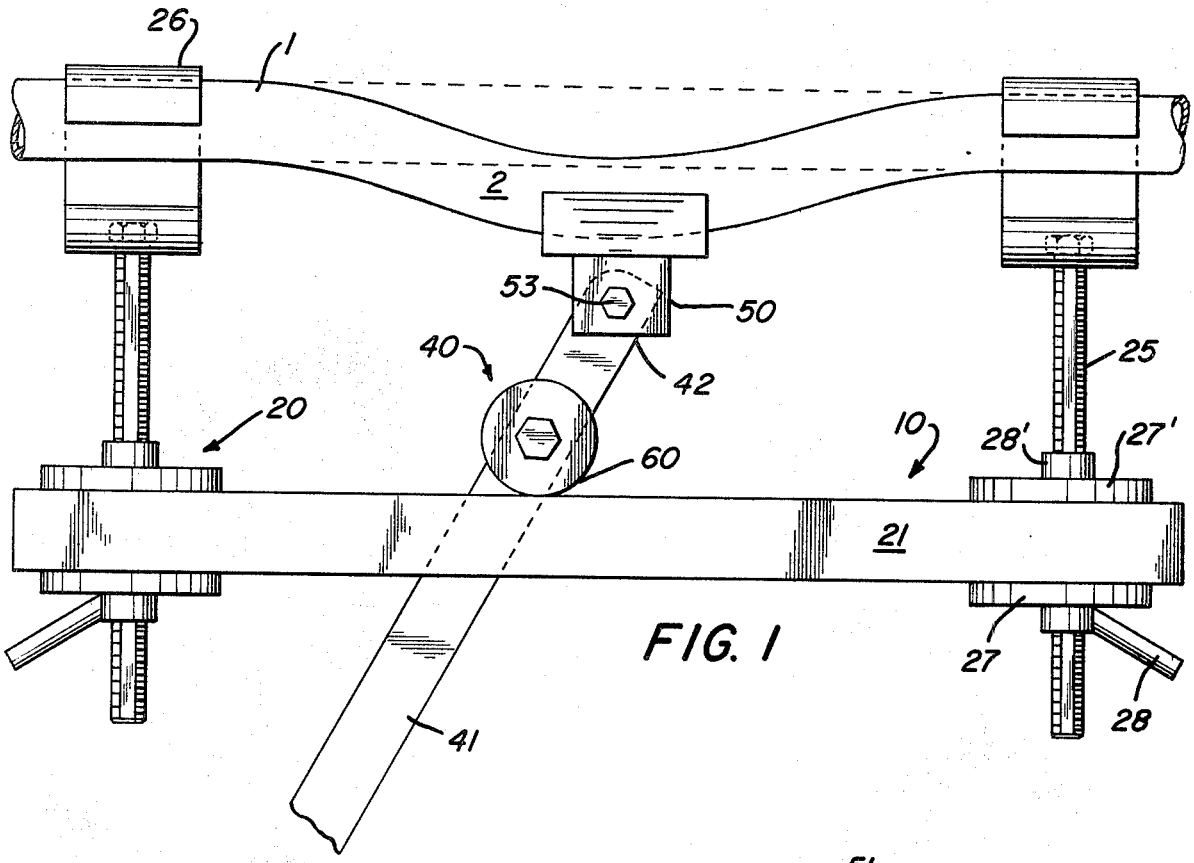
FIG. 1 is perspective view of the tube straightening device in use.
Figure 2:
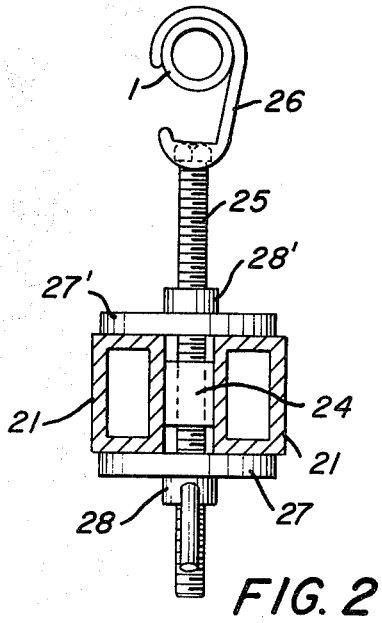
FIG. 2, is an end view of the apparatus.

As can be seen by reference to FIG. 1, the tube straightening apparatus that forms the present invention is designated generally as 10, and comprises two main components; a brace member 20, and a bar member 40.

The brace member 20, comprises a pair of elongated thick walled tubular pipe elements 21 having rectangular cross-sections, which are connected together at their ends in a spaced parallel relationship. The pipes 21 are connected together proximate their ends, by a pair of spacer elements 24, which separate the pipes from one another to create a gap therebetween. The spacer elements are joined to the pipes in any well recognized manner such as bolting, welding, adhesives, etc. The spacer elements 24, are further provided with a centrally disposed threaded aperture, that is dimensioned to receive an elongated threaded rod member 25.

One end of the threaded rod member 25, is provided with a generally C-shaped tube hook 26, and the other end of the rod member, is provided with adjusting plates 27, 27' and nuts 28, 28', whose purpose and function will be explained further on in the specification.

Figure 3:
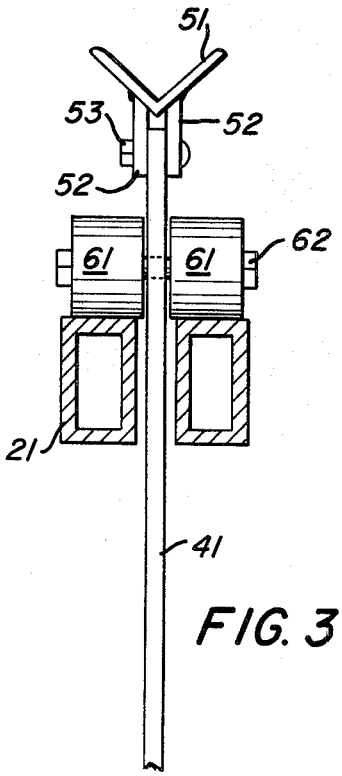
FIG. 3, is a detail view of the rolling fulcrum force applying mechanism.

Turning now to the bar member 40, as can best be seen in FIGS. 1 and 3, this component comprises an elongated lever arm 41, which is provided with a pivoted straightening member 50, on one end 42, and a rolling contact member 60, disposed proximate to, but spaced a substantial distance from the straightening member 50.

The straightening member 50, comprises a V-shaped straightening block 51, having a pair of downwardly projecting apertured ears 52. The straightening member 50, is further pivotally connected to the end 42, of the lever 40, via a bolt 53, that projects thru the ears 52, of the straightening member 50, and a first suitably dimensioned aperture (not shown) in the end of the lever 40.

The rolling contact member 60, comprises a pair of wheel members 61, disposed on either side of the lever 40, and mounted on an axle 62, which extends through a second suitably dimensioned aperture (not shown) in the lever 40. The axle 62, further forms the pivot point for the rolling fulcrum concept of this invention.

As best shown in FIG. 1, this arrangement allows the lever to be rolled back and forth along the length of a section of tube in the vicinity of a bend 2. When the straightening block 50, contacts the bend 2, at the point closest to the brace 20, force is applied to the lever 40, in a direction that will tend to bring the lever into a position perpendicular to the brace 20. This movement of the lever will force the bent portion of the pipe to the position indicated in phantom.

The rolling contact member 60, forms a rolling fulcrum for the lever 40, and by virtue of the length of the elongated lever arm 41, extending beyond the rolling contact member 50, any force applied to the free end of the lever arm will be multiplied proportionately.

In accordance with the aforementioned principles, the free end of the lever arm will be at least four times as long, as the length of the lever arm which extends from the rolling contact member 60, to the straightening member 50.

The straightening apparatus is employed as follows: The tube hooks 26, are slipped around a section of pipe on either side of a bend 2. The adjusting plates 27 and nuts 28, are then adjusted so that the brace pipes 21, are aligned parallel to the unbent section of pipe, and the unbent section of pipe will be engaged by the straightening block 50, when the lever arm 40 is disposed perpendicular to the brace pipes 21. The lever arm 41, is then turned to the right or to the left at the discretion of the user so that the straightening block 50, is disengaged from the unbent section of pipe. The lever arm 41, is then moved along the gap between the brace pipes 21, via the wheels 61, until the straightening block is positioned opposite the bent section of pipe. The lever arm 41, is then forced back in the direction that will bring it perpendicular to the braces or "string back" 21.

This process can be repeated several times from a variety of angles until the pipe section is straight. This is a cold bend operation that can be performed on-site, wherein the straightening forces can be applied in some instances around the entire circumference of a length of pipe.

Having thereby disclosed the subject matter of this invention, it should be obvious that many substitutions, modifications and variations are possible in light of the above teachings. It is therefore to be understood that the invention as taught and described is only to be limited to the extent of the breadth and scope of the appended claims.

What I claim is:

1. A tube straightening apparatus for performing cold bend, on-site straightening of a tube having a bent tube section, wherein the apparatus comprises:

an adjustable brace member adapted to be secured to the unbent sections of tube in a parallel relationship, wherein the adjustable brace member comprises a pair of parallel, spaced apart, elongated brace elements, which are connected together to form a gap therebetween, a lever member extending through, and operatively associated with, the brace member for pivotal and lateral rolling movement with respect thereto, wherein the lever member comprises; an elongated lever arm having a straightening block pivotally connected to one end, for contacting the bent tube section, and a rolling contact member rotatably disposed proximate to, but spaced from, said one end, said rolling contact member so that said lever is movable along the longitudinal extent of the brace member; and workpiece support members fixed to the brace and located on either side of the lever member.

2. A tube straightening apparatus as in claim 1; wherein, the other end of said elongated lever arm is dimensioned such that it will extend through the gap formed between the elongated brace elements.

3. A tube straightening apparatus as in claim 2, wherein the rolling contact member comprises;

a pair of wheels disposed on both sides of the lever arm and mounted on an axle, wherein the pair of wheels are adapted to rollingly engage the elongated brace elements; whereby the said axle will act as a pivot point to create a rolling fulcrum for the engagement of the lever member with a bent section of tube.

4. A tube straightening apparatus as in claim 3; wherein the distance between said rolling contact member and said other end of the lever arm, is at least four times the distance between said rolling contact member and said one end of the lever arm.

5. A tube straightening apparatus as in claim 3; wherein, the brace member further comprises workpiece support members comprising:

elongated threaded rods operatively connected on one end to the elongated brace elements proximate their ends, and operatively connected on their other ends to generally C-shaped tube hooks.

6. A tube straightening apparatus as in claim 5; wherein the brace member further comprises workpiece support members comprising:

an adjustable plate and nut arrangement disposed on said one end of the elongated threaded rods for adjusting the elongated brace elements into a parallel relationship with the unbent sections of tube.

7. A tube straightening apparatus as in claim 6; wherein said straightening block comprises:

a generally V-shaped member having a pair of projecting ears that are pivotally attached to the said one end of said lever arm.

* * * * *